US009637978B2

(12) United States Patent
Holloway

(10) Patent No.: US 9,637,978 B2
(45) Date of Patent: May 2, 2017

(54) DOWNHOLE STINGER GEOTECHNICAL SAMPLING AND IN SITU TESTING TOOL

(71) Applicant: CONOCOPHILLIPS COMPANY, Houston, TX (US)

(72) Inventor: George Leon Holloway, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 15/211,116

(22) Filed: Jul. 15, 2016

(65) Prior Publication Data

US 2017/0016279 A1 Jan. 19, 2017

Related U.S. Application Data

(60) Provisional application No. 62/193,414, filed on Jul. 16, 2015.

(51) Int. Cl.
*E21B 7/12* (2006.01)
*E21B 49/00* (2006.01)
(Continued)

(52) U.S. Cl.
CPC ..... *E21B 7/205* (2013.01); *E02D 1/022* (2013.01); *E02D 1/04* (2013.01); *E21B 7/12* (2013.01);
(Continued)

(58) Field of Classification Search
CPC . E21B 7/12; E21B 7/205; E21B 25/02; E21B 25/18; E21B 47/0001; E21B 47/04; E21B 49/001; E02D 1/022; E02D 1/04
See application file for complete search history.

(56) References Cited

U.S. PATENT DOCUMENTS 3,163,241 A * 12/1964 Daigle ..... E21B 25/00 175/20
3,412,814 A * 11/1968 Rosfelder ..... E21B 25/18 175/6

(Continued)

OTHER PUBLICATIONS

Young, A.G., et al—""CPT Stinger"—An Innovative Method to Obtain CPT Data for Integrated Geoscience Studies", 2011, Offshore Technology Conference held in Houston, TX on May 2-5, 2011, OTC 21569, pp. 1-10; 10 pgs.

(Continued)

*Primary Examiner* — Matthew R Buck
(74) *Attorney, Agent, or Firm* — ConocoPhillips Company

(57) ABSTRACT

Offshore system for delivering geotechnical tools to seafloor is described. The system includes a carrier tube that includes an upper end and a lower end, wherein the carrier tube is characterized by an outer diameter and an inner diameter and wherein the inner diameter of the carrier tube defines a hydraulic cylinder; a landing sub shaped or installed at or near the upper end of the carrier tube, wherein inner diameter of the landing sub is smaller than the inner diameter of the carrier tube; a drill bit shaped or installed at or near the lower end of the carrier tube; an extension tube extending upward from the upper end of the carrier tube; an upward seal that seals top portion of the extension tubes; a compression system for introducing compressed fluid under the upward seal; a fixed rod that runs through the hydraulic cylinder; a hydraulic piston disposed in the hydraulic cylinder, wherein the hydraulic piston is moveable along the fixed rod; one or more shear pins configured to restrict displacement of the hydraulic piston until a sufficient fluid pressure is built up; and an inner tube disposed between the carrier tube and the hydraulic piston, wherein lower portion of the inner tube includes a cone penetrometer that is (Continued)

ballistically inserted into the soil during downward displacement of the hydraulic piston.

20 Claims, 2 Drawing Sheets

(51) Int. Cl.

| | |
|---|---|
| ***E21B 7/20*** | (2006.01) |
| ***E21B 47/00*** | (2012.01) |
| ***E21B 47/04*** | (2012.01) |
| ***E02D 1/02*** | (2006.01) |
| ***E02D 1/04*** | (2006.01) |

(52) U.S. Cl.
CPC ..... *E21B 47/00* (2013.01); *E21B 47/04* (2013.01); *E21B 49/001* (2013.01)

(56) References Cited

U.S. PATENT DOCUMENTS

| | | | | |
|---|---|---|---|---|
| 3,438,452 | A * | 4/1969 | Bernard | E21B 25/18 175/20 |
| 3,870,112 | A * | 3/1975 | Castel | E21B 25/00 175/232 |
| 5,777,242 | A | 7/1998 | Zuidberg et al. | |
| 6,390,206 | B1 * | 5/2002 | Aardal | E21B 25/18 175/58 |
| 6,463,801 | B1 | 10/2002 | Young et al. | |
| 6,907,931 | B2 * | 6/2005 | Bessonart | E21B 25/00 166/336 |
| 8,773,947 | B2 * | 7/2014 | Payor | G01V 1/38 181/101 |
| 2008/0257636 | A1 | 10/2008 | Payor | |
| 2010/0050764 | A1 | 3/2010 | Foo et al. | |
| 2014/0305712 | A1 * | 10/2014 | Wilson | E21B 25/02 175/239 |

OTHER PUBLICATIONS

"Downhole Operation", Offshore Geotechnical brochure, 2013, Fugro NV, 2264 SG, Leidschendam, The Netherlands, www.fugro.com; 4 pgs.

Stress Engineering Services, Inc. Houston, et al—"Assembly Operation and Maintenance Manual, Fugro Hydraulic Piston Corer (FHPC)", Dec. 2002, Fugro-McClelland Marine Geosciences, Inc., 78 pgs.

International Search Report for PCT/US2016/042449, Filed Jul. 15, 2016; 3 pgs.

* cited by examiner

DOWNHOLE STINGER GEOTECHNICAL SAMPLING AND IN SITU TESTING TOOL

PRIOR RELATED APPLICATIONS

This application is a non-provisional application which claims benefit under 35 USC §119(e) to U.S. Provisional Application Ser. No. 62/193,414 filed Jul. 16, 2015, entitled "DOWNHOLE STINGER GEOTECHNICAL SAMPLING AND IN SITU TESTING TOOL," which is incorporated herein in its entirety.

FIELD OF THE DISCLOSURE

The present invention generally relates to offshore geotechnical tools. More specifically, the present invention provides a system for ballistically inserting a geotechnical tool into a seafloor.

BACKGROUND OF THE DISCLOSURE

Geotechnical information of the seafloor is often needed for proper engineering design of structures such as fixed leg jacket structures, tension leg platforms, spread moorings, gravity based structures and pipelines. The cone penetrometer is an in situ testing tool that can be used to perform cone penetrometer test ("CPT") to gather geotechnical engineering properties of seafloor. For most offshore applications, a large deployment system is needed to deliver the cone penetrometer to the seafloor. Typically, the cone penetrometer gathers data as its cone shaped tip is pushed into the soil at a near static or static rate of speed. The standard push velocity is ~2 cm/sec (±25%) according to industry accepted American Society for Testing and Material (ASTM) protocol. Readings are taken continuously every 1 cm to 5 cm or so to obtain continuously sampled static data. The length of the cone rod determines depth of push and varies typically from about 1.5 m to 4.5 m depending upon which system or specific tool is employed. In general, static CPT requires large and expensive equipment that can provide a stable platform at the seabed. Utilized from the stable platform, the cone penetrometer can then be inserted with a steady pressure at a controlled rate.

Various tools have been developed to deploy cone penetrometers in offshore environments. For deep-water investigations, a cone penetrometer can be operated in conjunction with wire-line drilling techniques with equipment mounted on a large drill vessel. Since the cone penetrometer is pushed at a constant rate, any drill string that secures the cone penetrometer to the vessel must remain immobilized so that the tool is essentially unaffected by vessel motion during the push. Immobilization of the drill string can be accomplished using a weighted seabed frame (SBF) that is designed to allow the drill string to be attached to the heavy weighted seabed frame (e.g., ~20,000 lbs). The SBF is normally lowered to the seabed prior to spudding a borehole from a large winch on the deck of the vessel. The SBF is lowered through a large center well through the vessel. The drill rig is usually positioned over the large center well. Drilling heave compensators are used for both the drillstring and SBF to reduce influence of sea waves. When the drill string is at a desired depth, hydraulic rams on the SBF are activated and clamp onto the drill string. Once the clamps grip the drill pipe firmly, weight of the SBF is added onto the drill string and allows the drill pipe to be essentially motionless (since it is now tied to the seafloor). The added weight of the SBF on the drill pipe provides the heave compensators with enough resistance to allow the drill string and SBF to remain motionless during the insertion of the cone penetrometer into the seabed.

A recently developed offshore cone penetrometer tool is "allowed to free fall" into the seafloor to gather both static and dynamic CPT data. As used herein, the term "static CPT data" refers to CPT data collected when a cone penetrator is pushed at a static rate (typically at ~2 cm/s). As used herein, the term "dynamic CPT data" refers to collection of CPT data at a non-static rate (much faster than 2 cm/s). An example of an offshore cone penetrometer system was described in a paper entitled "'CPT Stinger'—An Innovative Method to Obtain CPT Data for Integrated Geoscience Studies" presented at *Offshore Technology Conference* (May 2-5, 2011).

In this offshore cone penetrometer system, the cone sensor portion is installed using a large piston corer weight-head and allowed to free-fall and penetrate into the sediment to about 20 m. During this time, dynamic CPT data is gathered. Once the offshore cone penetrometer tool is embedded, the cone tip can be pushed down to about 40 m at a static push rate (~2 cm/s). The offshore cone penetrometer tool is designed to quickly assess soil properties by converting the dynamic CPT data to static CPT data using velocity algorithms. One of the main drawbacks of the offshore cone penetrometer tool is that the tool requires the use of a large seabed frame and heave compensator system. One primary limitation of the Stinger CPT tool is that it cannot measure CPT data beyond ~40 m (~20 m of dynamic data and ~20 m of static data).

SUMMARY OF THE DISCLOSURE

One example of an offshore system for in situ testing of soil includes: a) a carrier tube comprising an upper end and a lower end, wherein the carrier tube is characterized by an outer diameter and an inner diameter and wherein the inner diameter of the carrier tube defines a hydraulic cylinder; b) a landing sub shaped or installed at or near the upper end of the carrier tube, wherein inner diameter of the landing sub is smaller than the inner diameter of the carrier tube; c) a drill bit shaped or installed at or near the lower end of the carrier tube; d) a series of extension tubes extending upward from the upper end of the carrier tube; e) an upward seal that seals top portion of the extension tubes; f) a compression system for introducing compressed fluid under the upward seal; g) a fixed rod that runs through the hydraulic cylinder; h) a hydraulic piston disposed in the hydraulic cylinder, wherein the hydraulic piston is moveable along the fixed rod; i) one or more shear pins configured to restrict displacement of the hydraulic piston until a sufficient fluid pressure is built up; and j) an inner tube disposed between the carrier tube and the hydraulic piston, wherein lower portion of the inner tube includes a cone penetrometer that is ballistically inserted into the soil during downward displacement of the hydraulic piston.

Another example of an offshore system for collecting high quality soil samples comprising: a) a carrier tube comprising an upper end and a lower end, wherein the carrier tube is characterized by an outer diameter and an inner diameter, wherein the inner diameter of the carrier tube defines a hydraulic cylinder; b) a landing sub shaped or installed at or near the upper end of the carrier tube, wherein inner diameter of the landing sub is smaller than the inner diameter of the carrier tube; c) a drill bit shaped or installed at or near the lower end of the carrier tube; d) a series of extension tubes extending upward from the upper end of the carrier tube; e) an upward seal that seals top portion of the extension tubes; f) a compression system for introducing compressed fluid under the upward seal; g) a fixed rod that runs through the hydraulic cylinder; h) a hydraulic piston disposed in the hydraulic cylinder, wherein the hydraulic piston is moveable along the fixed rod; i) one or more shear pins configured to restrict displacement of the hydraulic piston until a sufficient fluid pressure is built up; and j) an inner tube disposed between the carrier tube and the hydraulic piston, wherein lower portion of the inner tube includes a soil sampler that is ballistically inserted into the soil during downward displacement of the hydraulic piston and wherein the soil sampler includes a valve that allows collection of soil sample after the ballistic insertion.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated.

The following examples of certain embodiments of the invention are given. Each example is provided by way of explanation of the invention, one of many embodiments of the invention, and the following examples should not be read to limit the scope of the invention.

The present invention provides offshore dynamic delivery systems and methods for deploying geotechnical tools in an offshore environment. Certain testing tools take measurements (e.g., tip resistance, sleeve resistance, pore pressure, friction, etc.) in situ while soil samplers (e.g., piston sampler) collect soil samples that are analyzed above water. The geotechnical tools can be in situ testing probe (e.g., cone penetrometer), soil sampler, or any other compatible tool that can be inserted into seafloor. The dynamic delivery system includes mechanisms that allow the geotechnical tool to be ballistically inserted into the soil during a stroke action. As such, the offshore dynamic delivery system allow soil samples or geotechnical data to be collected very rapidly at greater depths without compromising quality of sample or data.

Figure 1A:
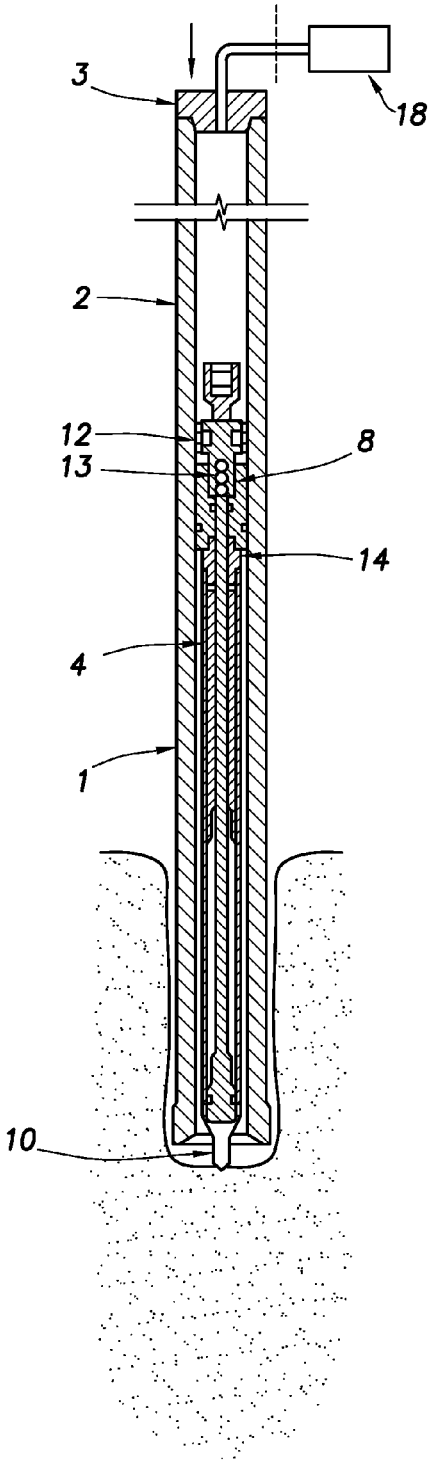
FIGS. 1A-1B illustrates a dynamic delivery system with cone penetrometer before (FIG. 1A) and after stroke (FIG. 1B).
Figure 1B:
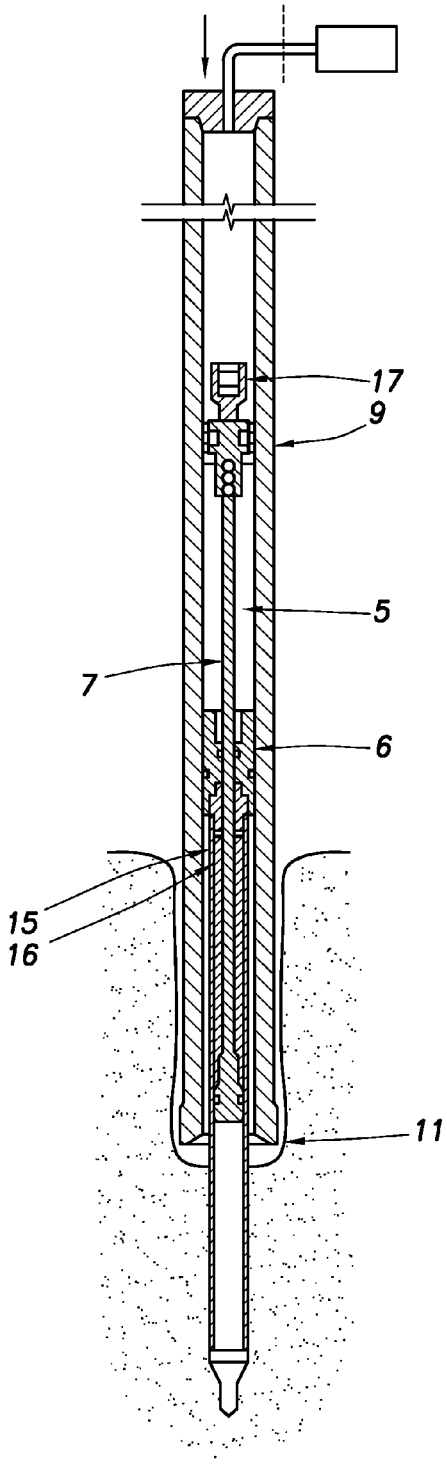

The dynamic delivery system also allows in situ testing or sampling of soil without the need for a large drill vessel equipped with a heave compensator, center well, or SBF. The collected CPT data can include, for example, pore pressure data with depth prior to conductor/casing installation, accurate heat flow measurements for hydrate assessment, cost effective data for accurate foundation concept evaluation, as well as geotechnical data for temperature profile measurements, soil shear strength, and the like. Other advantages of the present invention include, but are not limited to, the following:

- Dynamic CPT data is collected from within a borehole deployed tool without using a reaction mass (e.g., sea bed frame) to immobilize the drill string
- Smaller vessels without a large center well or heave compensation system can be used to deploy the tool system
- Heave compensation system is not needed due to the speed in which the tool is activated
- Equipment cost is significantly reduced
- Time associated with obtaining soil sample (e.g., exploration rigs can run triple stands of drill pipe instead of a single joint of pipe that is typically deployed from geotechnical drill ship) is significantly reduced
- System allows other sensors/tools to be deployed
- Any drilling fluid introduced into the drill string can be used to build up fluid pressure FIGS. 1A-1B illustrate the dynamic delivery system of the present invention featuring a cone penetrometer 10 before (FIG. 1A) and after stroke (FIG. 1B) action of its hydraulic piston 6. The dynamic delivery system includes a carrier tube 1 that serves to house some key elements of the dynamic delivery system. These elements include a fixed rod 7 that runs along the axial length of the carrier tube 1 and an inner tube 4 that is concentric to the carrier tube 1 and disposed between the carrier tube 1 and the fixed rod 7. The cone penetrometer 10 is outfitted at the bottom portion of the inner tube 4. The drill head 11 is installed at the bottom portion of the carrier tube 1.

The hydraulic piston 6 and inner tube 4 rests inside a hydraulic cylinder 5 that is defined by the inner diameter of the carrier tube 1. The hydraulic piston 6 sits above the inner tube 4 and the two are moveable in unison (upward or downward) along the fixed rod 7. The fixed rod 7 may include anti-spiral grooves that prevents rotational movement of the cone penetrometer 10. Vertical movement of the hydraulic piston 6 is restricted by shear pins 8 which locks the hydraulic piston in place before the stroke. As shown, the shear pins 8 are installed into the slots for the shear pins. Shear pin bushings 13 are installed on either side of the piston to help ensure repeatable shoot off pressures.

As shown, the top portion of the carrier tube 1 is connected to an extension tube 2 (e.g., drill string). An upward seal 3 (e.g., packer) covers the extension tube 2 with an opening in the seal that allows fluids to be introduced into the system. In one embodiment, fluids can be introduced into the system (bolded arrow indicates direction of fluid) via a compression device (e.g., a pump) that compresses fluids under the upward seal 3. The compressed fluid can build up pressure inside the system that leads to the eventual failure of the shear pins 8 and ballistic firing of the hydraulic piston 6. At predetermined pressure, the piston is instantaneously accelerated and forces the cone penetrometer 11 into the soil at the bottom of the borehole. The velocity of the firing is regulated by built up fluid pressure, which can be controlled by number of shear pins and/or material of the shear pins. Landing sub 9 can also be fashioned or installed at or near the top portion of the carrier sub 1. The landing sub 9 has an inner diameter smaller than the carrier tube 1 and essentially provides shoulders that allows certain housed elements to be seated.

Initially, the dynamic delivery system is positioned slightly above seafloor and then fired to obtain a cone penetrometer measurement that starts at the seafloor interface. The carrier tube is then advanced into the seafloor by the length of the initial CPT embedment. As shown in FIG. 1A, a portion of the carrier tube 1 is drilled/inserted into the soil before stroke takes place. During the stroke, the cone penetrometer 10 and at least a portion of the inner tube 4 are ballistically inserted deeper into the soil. This ballistic insertion is possible because the drill head 11 has an opening that allows elements housed inside the carrier tube 1 to thrust into the soil in coordination with movement of the hydraulic piston 6 (FIG. 1B).

A speed control device 12 allows fluid under pressure to pass into the hydraulic cylinder 5 at varying flow rate in order to control descent velocity rate of the hydraulic piston 6. Vent sub 15 and snubber 16 prevent damage to the dynamic delivery system if the system is accidently fired above the seafloor or without sufficient sediment to retard the driving force before reaching end of the stroke. Quick release mechanism 14 allows the system to be easily and repeatedly broken down into at least two main parts for improved handling. A cup type or spear type control knob 17 is used to latch onto a wireline overshot to catch and recover the geotechnical tool back to the surface. This process is repeated for each advancement of the CPT.

Because the CPT is not controlled in its advancement rate, it does not require a seabed frame to provide reaction for a heave compensator since insertion of the CPT is <2 sec. (i.e., less than typical ocean wave length period). Since the CPT is inserted so fast, it is unaffected by vessel heave cause by the sea state at the time of operation.

Figure 2A:
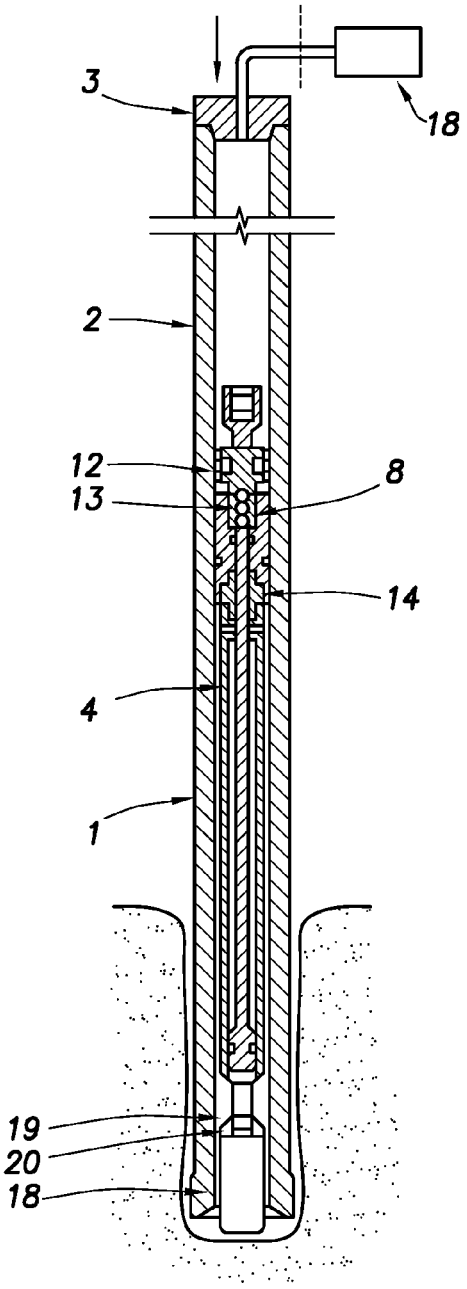
FIGS. 2A-2B illustrates a dynamic delivery system with soil sampler before (FIG. 2A) and after stroke (FIG. 2B).
Figure 2B:
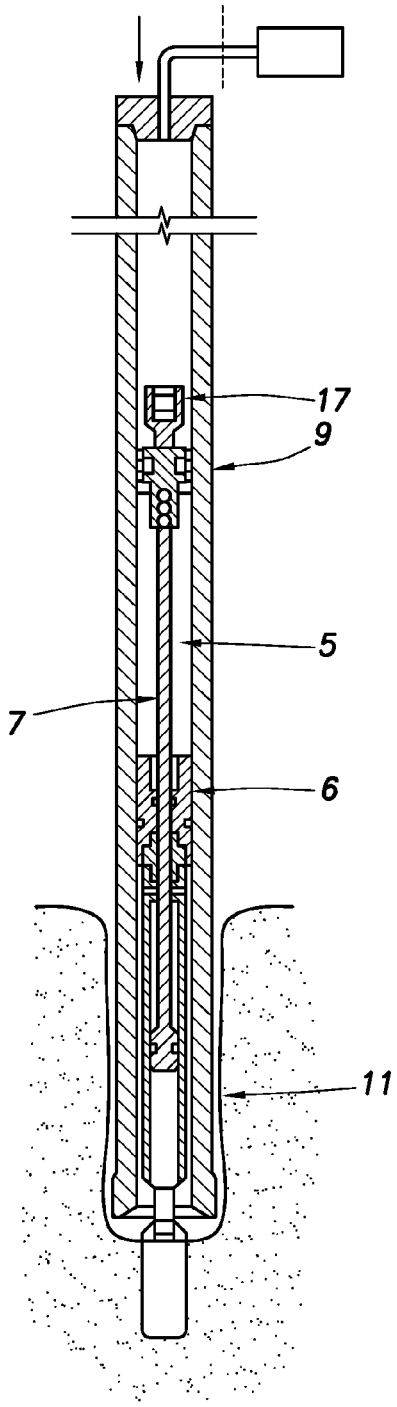

FIGS. 2A-2B illustrate a dynamic delivery system featuring a soil sampler 18 in place of the cone penetrometer 11 shown in FIGS. 1A-1B. The soil sampler 18 includes a sampler vents 19 and sampler valve 20 designed to help collect a soil sample. During ballistic insertion, soil flows through the soil sampler 18 and out of the sampler vents 19. As soon as the sampler enters the soil at a high acceleration from the stored energy within the drill pipe, the sampler de-accelerates as it advances into the virgin soil.

In one embodiment, the soil sampler 18 can be configured into various lengths. Because the soil sampler is not controlled in its advancement rate, it does not require a seabed frame to provide reaction for a heave compensator since insertion of the sample barrel is <2 sec. (i.e., less than typical ocean wave length period). Since the soil sampler is inserted so fast, it is unaffected by vessel heave cause by the sea state at the time of operation.

When the system stops at a pre-set depth, the soil at that depth inside the sampler is captured by the sampler valve 20 at the top of the soil sampler 18. Valve closure is accomplished by upward movement of the soil sampler 18 when the drill string (i.e., extension tube, carrier tube and drill bit) are raised above the bottom of the hole or when the system is lifted with a wireline retrieval tool.

Referring to both embodiments shown in FIGS. 1A-2B, the carrier tube 1 may be lowered into the sea from a vessel via connection to a series of extension tubes (i.e., drill-string). The housed elements are lowered into the carrier portion (carrier tube 1) via a wireline or allowed to free fall with the extension tubes resting on a landing shoulder (landing sub 9) within the carrier portion of the tool. A compression system 18 (e.g., pump) is connected to the top of the extension tube so that a seal is formed between the top of the extension tubes and the inner portion of the tool when properly seated in the carrier. No external locking arrangement is needed to hold the inner tube in place. This sealing allows fluid in the extension tubes to be compressed with the introduction of additional fluid which results in a pressure build up. The inner elements are then fired into the formation under this pressure buildup of fluid in the extension tubes. The actual firing pressure (i.e. force) is dependent the type of material that are used in the selection of the shear pins. A number of firing pressure combinations are available based in the type and strength of shear pins used.

Upon reaching the maximum shear force offered by the available shear pins selected, the inner elements are instantaneously accelerated into the formation where the soil resistance eventually slows the tools advancement rate with a decreasing acceleration until it reaches the lessor of its maximum penetration or a shorter length based on the amount of resistance that the soil achieves with side wall contact from the probe or sample barrel. A hydraulic cylinder constitutes part of the carrier tube so that the piston forms a seal directly against the inner wall of the carrier tube. The seal is provided on the outer circumferential portion of the inner tube with the carrier tube which seals the hydraulic cylinder to allow the analysis to take place.

Upon recovery to deck, raw data file generated from the ballistic insertion can be analyzed and processed into acceleration, velocity, and depth measurements using the same electronic memory module that is deployed with the CPT. The soil sample collected is identical to industry standard 3" Shelby tubes.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. An offshore system for in situ testing of soil comprising:

a) a carrier tube comprising an upper end and a lower end, wherein the carrier tube is characterized by an outer diameter and an inner diameter and wherein the inner diameter of the carrier tube defines a hydraulic cylinder;

b) a landing sub shaped or installed at or near the upper end of the carrier tube, wherein an inner diameter of the landing sub is smaller than the inner diameter of the carrier tube;

c) a drill bit shaped or installed at or near the lower end of the carrier tube;

d) a series of extension tubes extending upward from the upper end of the carrier tube;

e) an upward seal that seals a top portion of the extension tubes;

f) a compression system for introducing compressed fluid under the upward seal;

g) a fixed rod that runs through the hydraulic cylinder;

h) a hydraulic piston disposed in the hydraulic cylinder, wherein the hydraulic piston is moveable along the fixed rod;

i) one or more shear pins configured to restrict displacement of the hydraulic piston until a sufficient fluid pressure is built up; and j) an inner tube disposed between the carrier tube and the fixed rod, wherein a lower portion of the inner tube includes a cone penetrometer that is ballistically inserted into the soil during downward displacement of the hydraulic piston.

2. The offshore system of claim 1, wherein the hydraulic cylinder includes a passage for buildup of fluid pressure above the hydraulic piston.

3. The offshore system of claim 1, further comprising a speed control device that allows fluid under pressure to pass into the hydraulic cylinder at varying flow rate that controls descent velocity rate of the hydraulic piston.

4. The offshore system of claim 1, wherein the sufficient fluid pressure leads to failure of the one or more shear pins.

5. The offshore system of claim 1, further comprising hardened shear pin bushing.

6. The offshore system of claim 1, further comprising a venting device that retards driving force during stroke of the hydraulic piston.

7. The offshore system of claim 1, wherein the hydraulic piston is keyed with anti-spiral grooves to prevent rotation of the cone penetrometer.

8. The offshore system of claim 1, further comprising a processor for converting dynamic data parameter measurements into electrical signals.

9. The offshore system of claim 1, further comprising:

a battery; and memory configured to store measurement data obtained from the cone penetrometer.

10. The offshore system of claim 1, wherein the cone penetrometer comprises:

an electronic data processing system that summarizes dynamic data from the cone penetrometer; and a display that converts dynamic data into one or more parameters selected from the group consisting of: acceleration, velocity, and depth.

11. An offshore system for collecting high quality soil samples comprising:

a) a carrier tube comprising an upper end and a lower end, wherein the carrier tube is characterized by an outer diameter and an inner diameter, wherein the inner diameter of the carrier tube defines a hydraulic cylinder;

b) a landing sub shaped or installed at or near the upper end of the carrier tube, wherein an inner diameter of the landing sub is smaller than the inner diameter of the carrier tube;

c) a drill bit shaped or installed at or near the lower end of the carrier tube;

d) a series of extension tubes extending upward from the upper end of the carrier tube;

e) an upward seal that seals a top portion of the extension tubes;

f) a compression system for introducing compressed fluid under the upward seal;

g) a fixed rod that runs through the hydraulic cylinder;

h) a hydraulic piston disposed in the hydraulic cylinder, wherein the hydraulic piston is moveable along the fixed rod;

i) one or more shear pins configured to restrict displacement of the hydraulic piston until a sufficient fluid pressure is built up; and j) an inner tube disposed between the carrier tube and the fixed rod, wherein a lower portion of the inner tube includes a soil sampler that is ballistically inserted into the soil during downward displacement of the hydraulic piston and wherein the soil sampler includes a valve that allows collection of soil sample after the ballistic insertion.

12. The offshore system of claim 11, wherein the hydraulic cylinder includes a passage for buildup of fluid pressure above the hydraulic piston.

13. The offshore system of claim 11, further comprising a speed control device that allows fluid under pressure to pass into the hydraulic cylinder at varying flow rate that controls descent velocity rate of the hydraulic piston.

14. The offshore system of claim 11, wherein the sufficient fluid pressure leads to failure of the one or more shear pins.

15. The offshore system of claim 11, further comprising hardened shear pin bushing.

16. The offshore system of claim 11, further comprising a venting device that retards driving force during stroke of the hydraulic piston.

17. The offshore system of claim 11, wherein the soil sampler has an outer diameter of about 3 inches.

18. The offshore system of claim 11, wherein the valve allows soil to flow through the soil sampler during downward movement the soil sampler.

19. The offshore system of claim 11, wherein the valve closes during upward movement of the soil sampler.

20. The offshore system of claim 11, further comprising a processor for processing data generated from the ballistic insertion into acceleration, velocity, or depth measurement.

* * * * *